US006398543B1

(12) United States Patent
Wymaster

(10) Patent No.: US 6,398,543 B1
(45) Date of Patent: Jun. 4, 2002

(54) METHOD AND FLOW CONTROL DEVICE FOR DELIVERING FUEL OIL TO A LOW FIRING RATE FUEL OIL BURNER

(76) Inventor: Noel A. Wymaster, 2817 Sierra Vista Way, Bishop, CA (US) 93514

( * ) Notice: Subject to any disclaimer, the term of this patent is extended or adjusted under 35 U.S.C. 154(b) by 0 days.

(21) Appl. No.: 09/584,889

(22) Filed: Jun. 1, 2000

(51) Int. Cl.[7] ..... F23C 5/00

(52) U.S. Cl. ..... 431/8; 431/12; 431/354; 251/126; 138/46

(58) Field of Search ..... 431/8, 12, 353, 431/352, 264, 258, 344, 354; 251/126; 138/46

(56) References Cited

U.S. PATENT DOCUMENTS

| | | | | | |
|---|---|---|---|---|---|
| 1,036,758 | A | * | 8/1912 | Walters et al. | 251/126 |
| 3,143,145 | A | * | 8/1964 | Kauss | 138/43 |
| 3,198,237 | A | * | 8/1965 | Sadler | 431/344 |
| 4,044,991 | A | * | 8/1977 | Waller | 251/126 |
| 4,506,423 | A | * | 3/1985 | Nakamura et al. | 251/126 |
| 5,281,132 | A | | 1/1994 | Wymaster | |
| 5,566,887 | A | | 10/1996 | Wymaster, Jr. | |
| 5,681,162 | A | * | 10/1997 | Nabores, Jr. et al. | 431/8 |

* cited by examiner

*Primary Examiner*—James C. Yeung
(74) *Attorney, Agent, or Firm*—Loyal McKinley Hanson

(57) ABSTRACT

A method for delivering fuel oil from a pressurized fuel oil source to an airblast atomizer subassembly on a low firing rate fuel oil burner includes providing a flow control device having a body defining a bore extending between and inlet end of the bore and an outlet end of the bore. The flow control device includes a rod disposed coaxially within the bore in a close fitting relationship. At least one of the bore and the rod is threaded (i.e., includes a groove extending along a helical path) to define a passageway extending along a circuitous, helical path intermediate the input and output ends of the bore through which the fuel oil must pass in flowing from the input end to the output end. The passageway has a size and shape adapted to achieve a desired rate of flow of the fuel oil to the airblast atomizer subassembly (e.g., less than 1.0 gallons per hour and typically less than 0.5 gallons per hour). The method proceeds by delivering the fuel oil through the passageway in the flow control device. One embodiment of the flow control device has a threaded bore. Another has a threaded rod. Yet another is adapted to attach directly to the atomizer subassembly, while still another has fittings enabling placement in a fuel oil line apart from the atomizer subassembly.

16 Claims, 5 Drawing Sheets

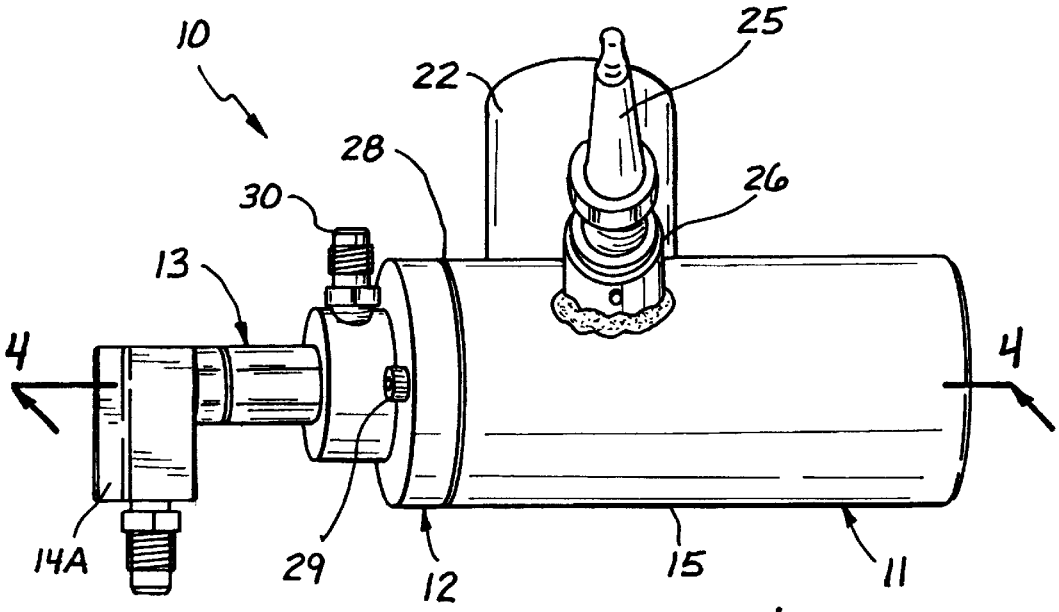
Fig. 1
Fig. 3
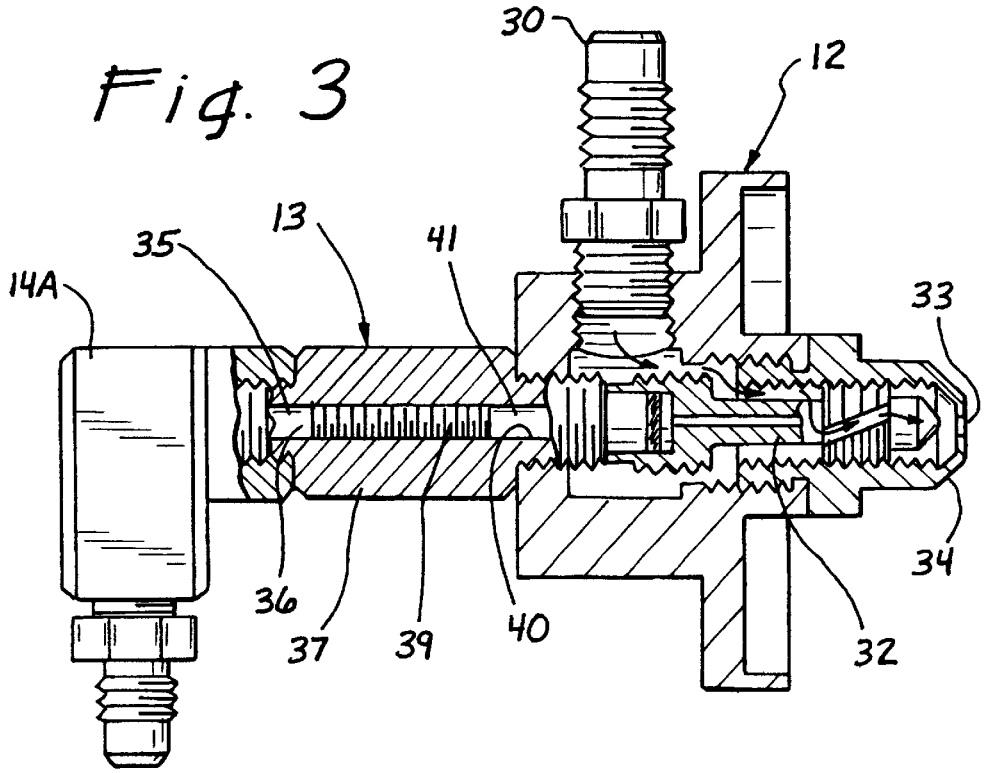

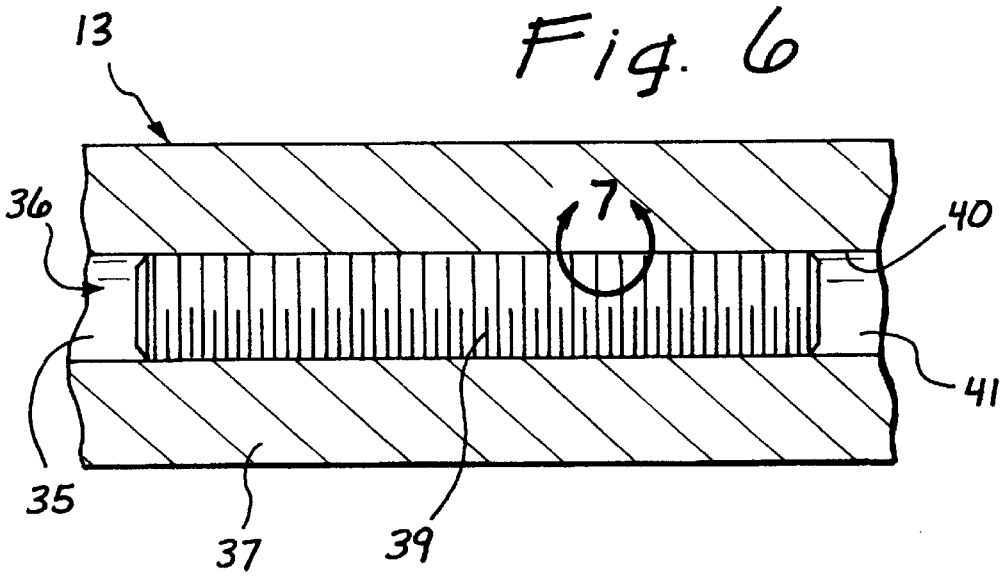
Fig. 6
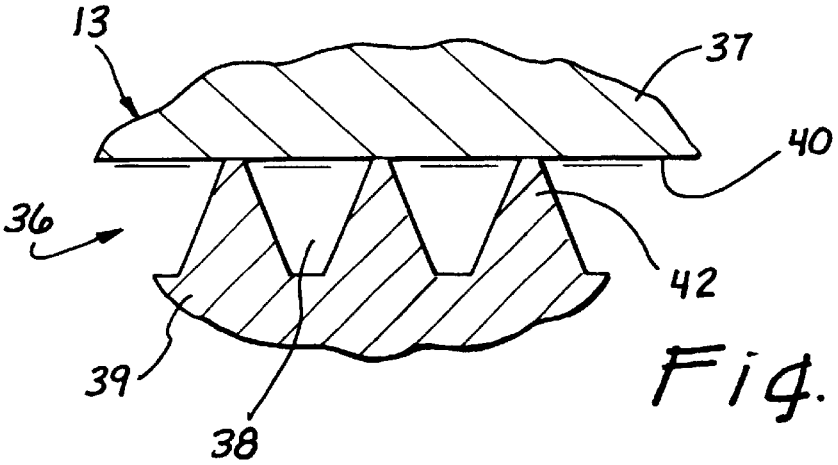
Fig. 7
Fig. 8
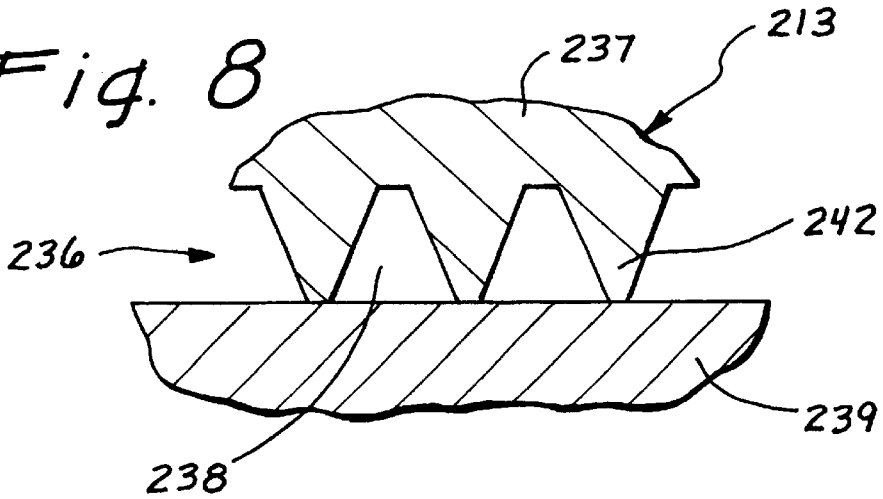

METHOD AND FLOW CONTROL DEVICE FOR DELIVERING FUEL OIL TO A LOW FIRING RATE FUEL OIL BURNER

BACKGROUND OF THE INVENTION

1. Technical Field

This invention relates generally to oil fired equipment, and more particularly to a method and flow control device for delivering fuel oil to a low firing rate fuel oil burner assembly.

2. Description of Related Art

Home heating fuel oil provides an excellent source of heat for the home. A 33-inch cube of Number 2 fuel oil, for example, has the heat energy of one ton of wood pellets or two-thirds cord of firewood. Fuel oil is less expensive than electricity, kerosene, pellets, propane, and natural gas. It is safer too. It will not burn at room temperature without atomization. Some would even extinguish a lighted match in it to demonstrate that attribute.

But certain problems arise in various home, recreational vehicle, and other applications requiring a low firing rate corresponding to a fuel flow rate below about 1.0 gallons per hour and typically less than 0.5 gallons per hour (i.e., less than 70,000 BTU/hr). Conventional pressure atomizer techniques and conventional airblast atomizer techniques are inadequate. So, users need a better fuel oil burner for low firing rates.

Consider a conventional pressure atomizer. It utilizes a pump to pressurize the fuel oil and deliver it to the atomizer. The atomizer contains a small orifice through which the fuel oil passes just before it enters the combustion zone. The size of the orifice determines fuel oil velocity, which in turn affects the atomization characteristics of the spray produced. If the velocity is too low, the spray will be too course and combustion quality and heater efficiency will suffer. As the flow rate is decreased (e.g., to meet low firing rate requirements), fuel oil velocity decreases and atomization degradation occurs.

In order to keep fuel oil velocity high, the size of the orifice can be reduced. But, there is a limit. At very small sizes, the orifice begins to plug as particulate matter in the fuel oil blocks the orifice. In addition, the high heat flux at the atomizer degrades the fuel oil and formation of deposits block the orifice. While very small orifice atomizers exist for conventional burners, few approach 0.5 gallons per hour due to after-drip, fuel cracking, and coking.

What about reducing pressure? That does not work either. For reasonable size orifices, the pressure must be reduced to such low levels that variations in pump characteristics, the height of the fuel tank (which controls the pressure head to the pump), partial clogging of filters, and the fuel level in the tank all begin to have unacceptably large effect on the flow rate. More importantly, the atomization quality of pressure atomizers suffers at lower pressures.

So, consider an airblast atomizer. It involves the use of compressed air to atomize the fuel oil as described in U.S. Pat. Nos. 5,281,132 and 5,566,887. Instead of relying on the fuel oil pressure to accomplish atomization, high velocity air flows over, or in close proximity to, a low velocity stream of fuel oil. The air breaks the fuel into very fine droplets and propels these droplets into the combustion zone. An excellent spray distribution and very small droplet size result, and the orifice can be large enough to avoid plugging.

The problem is that in order to provide the low firing rates desired, the fuel oil pressure at the input to the airblast atomizer must be so small that slight variations in the fuel pump pressure setting, variations in the fuel oil tank height relative to the burner, variations in the fuel oil level within the tank, small degrees of filter clogging, and other factors can all have an unacceptably large affect on the small fuel oil flow rate. Thus, prior art fuel oil burner techniques are not entirely satisfactory for low firing rate applications, and a need exists for a better low firing rate fuel oil burner assembly.

SUMMARY OF THE INVENTION

This invention addresses the need outlined above by providing a flow control device having a rod in a bore, with at least one of the rod and the bore being threaded to define a passageway extending along a circuitous, helical path. The passageway has a size and shape adapted to achieve a desired rate of flow of the fuel oil (e.g., less than 1.0 gallons per hour for some applications and typically less than 0.5 gallons per hour). The fuel oil is delivered from a pressurized fuel oil source to the airblast atomizer subassembly through the passageway in the flow control device.

Thus, the invention takes advantage of fuel oil benefits in various applications, including some that were previously the domain of natural gas and liquid petroleum gas. It does so with a readily fabricated device embodying a new and non-obvious combination of elements that enable the use of fuel oil at a low firing rate.

To paraphrase some of the more precise language appearing in the claims, a method for delivering fuel oil from a pressurized fuel oil source to an airblast atomizer subassembly on a low firing rate fuel oil burner assembly includes the step of providing a flow control device having a body defining a bore extending between and inlet end of the bore and an outlet end of the bore. The flow control device includes a rod disposed coaxially within the bore in a close fitting relationship. At least one of the bore and the rod is threaded to define a passageway extending along a circuitous path intermediate the input and output ends of the bore through which the fuel oil must pass in flowing from the input end of the bore to the output end of the bore. The passageway has a size and shape adapted to achieve a desired rate of flow of the fuel oil (e.g., typically to less than 0.5 gallons per hour). The method proceeds by delivering the fuel oil from the pressurized fuel oil source at a relatively high pressure (e.g., 60 to 100 pounds per square inch) to the airblast atomizer subassembly through the passageway in the flow control device.

The relatively high pressure helps provide a stable flow rate that is less subject to change with upstream fuel pressure fluctuations. The flow control device serves the purpose of allowing fuel oil to be delivered from the fuel oil source to the flow control device at the relatively high pressure. The flow control device introduces a pressure drop ahead of the airblast atomizer that results in fuel flowing to the atomizer at a slow steady rate. This is done through passageways with larger cross sectional sizes, and that results in the passageways being less prone to become plugged.

In line with the above, a flow control device constructed according to the invention for delivering fuel oil from a separate source of pressurized fuel to an airblast atomizer subassembly on a low firing rate fuel oil burner assembly, includes a rod within a bore to define a passageway extending along a circuitous path as specified above. One embodiment of the flow control device is adapted to attach directly to the airblast atomizer subassembly. Another embodiment includes fittings that enable placement in the fuel line apart from the airblast atomizer subassembly.

The flow control device is simple and inexpensive to manufacture. It is compact. One embodiment takes the form of a precision machined threaded rod and a smooth bore, with the threads of the rod and the wall of the bore defining a passageway extending along a helical path that the fuel oil must follow. Another embodiment includes a threaded bore and a smooth rod. Passageway size and length can be accurately set for a desired flow rate, and the device can be integrated into any of various airblast fuel oil burner designs to produce a low firing rate fuel oil burner assembly according to the invention.

A low firing rate fuel oil burner assembly constructed according to the invention includes a burner subassembly defining a combustion chamber in which to burn atomized fuel oil, and an airblast atomizer subassembly connected to the burner subassembly that is adapted to produce the atomized fuel oil. A flow control device as specified above is disposed somewhere in the fuel line intermediate the fuel oil source and the airblast atomizer subassembly to achieve a desired flow rate of the fuel oil.

Such an oil burner assembly can be suitably configured with any of various appropriate heat exchanger designs to function as a small space heater, a wall heating unit of the type installed between two studs, a refrigerator, an oil-powered space cooling unit, an efficient domestic hot water generation unit, or a clothes dryer. It can be configured to function as an oil-powered oven or cook top, an oil lighting fixture, or a spacing heating or cooling unit for recreational vehicles or larger boats. The following illustrative drawings and detailed description make the foregoing and other objects, features, and advantages of the invention more apparent.

BRIEF DESCRIPTION OF THE DRAWINGS

FIG. 1 of the drawings is an isometric view of an oil burner assembly constructed according to the invention;

FIG. 3 is a side view of the airblast atomizer subassembly and flow control subassembly with portions in cross section;

FIG. 6 is an enlarged cross sectional view of a portion of the flow control subassembly in FIG. 5 showing aspects that also apply to the flow control subassembly in FIGS. 1–4;

FIG. 7 a further enlarged view of a portion of FIG. 6 that is identified by a line 7—7 in FIG. 6;

FIG. 8 is an enlarged view similar to FIG. 7 of yet another flow control subassembly constructed according to the invention in which the bore is threaded instead of the rod.

DESCRIPTION OF THE PREFERRED EMBODIMENTS

Figure 2:
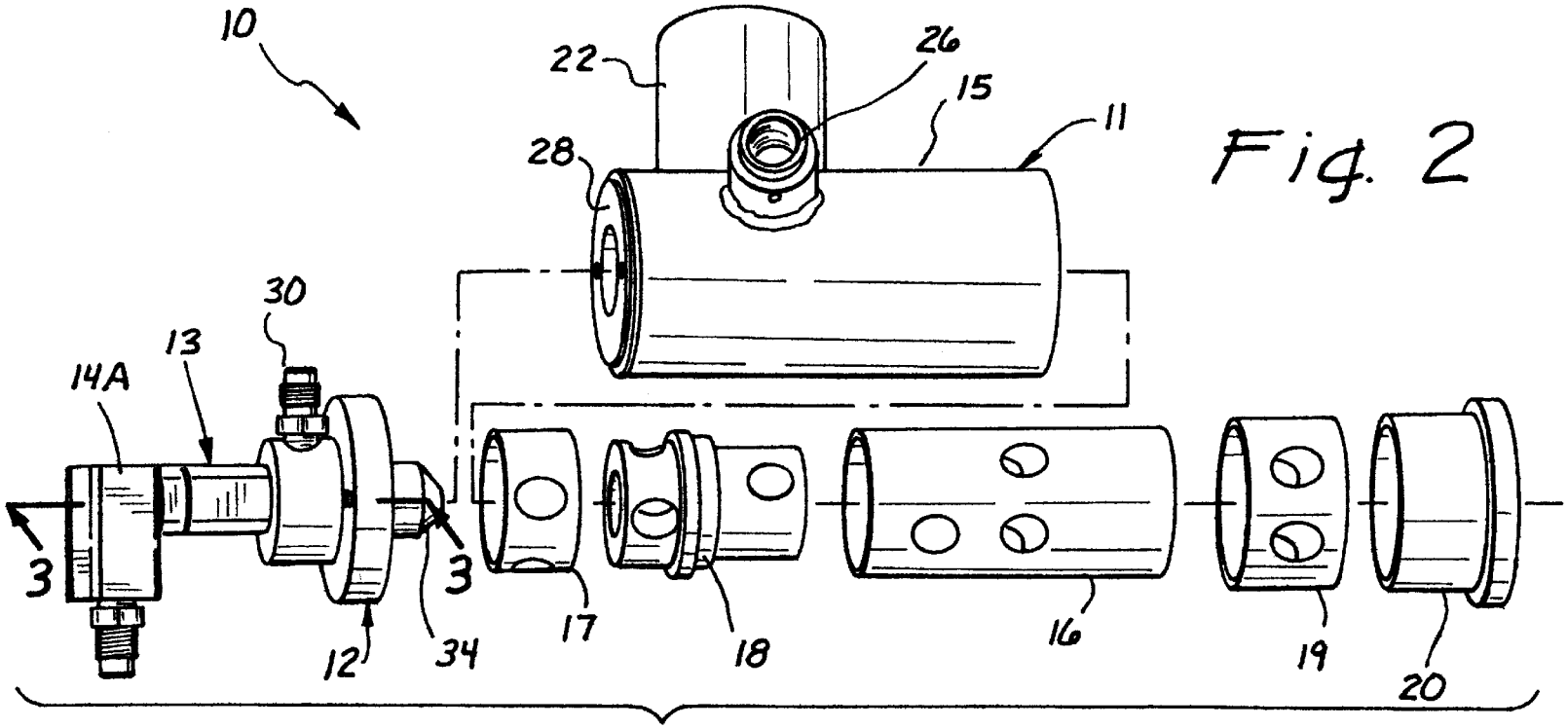
FIG. 2 is a disassembled view of the oil burner assembly showing the relationship of some of the component parts.

FIGS. 1–9 of the drawings show various aspects of a method and flow control device for delivering fuel oil to a low firing rate oil burner assembly 10 according to the invention. Generally, the oil burner assembly 10 includes a burner subassembly 11 that is sometimes called a burner tube assembly (FIGS. 1, 2, 4, and 9). It also includes an atomizer subassembly 12 that is sometimes called an airblast atomizer subassembly (FIGS. 1–4, and 9), and a flow control device 13 (FIGS. 1–4, 6, 7, and 9). Those components cooperate to enable fuel oil delivered from a separate fuel oil source 14 (FIG. 9) to burn at a low firing rate in the burner subassembly 11 by delivering the fuel oil to the atomizer subassembly 12 through the flow control device 13 in order to achieve a rate of flow of the fuel oil that is typically equal to less than 0.5 gallons per minute.

The burner subassembly 11 is fabricated of a suitably strong, rigid material (e.g., steel). It may employ some known technology and reference may be made to U.S. Pat. Nos. 5,281,132 and 5,566,887 for additional details. It defines a combustion chamber in which the fuel oil burns.

Figure 4:
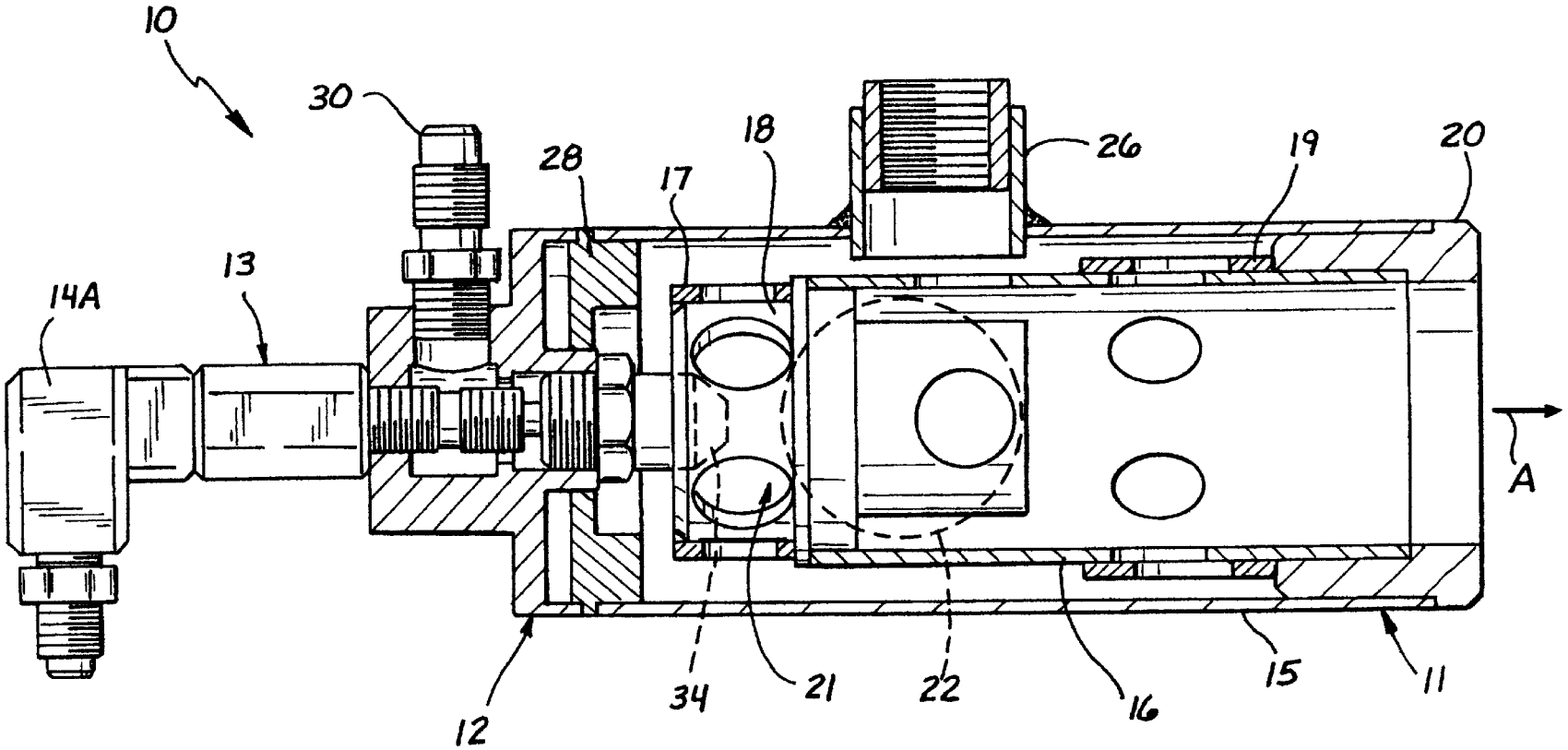
FIG. 4 is a side view of the burner subassembly with portions in cross section.
Figure 9:
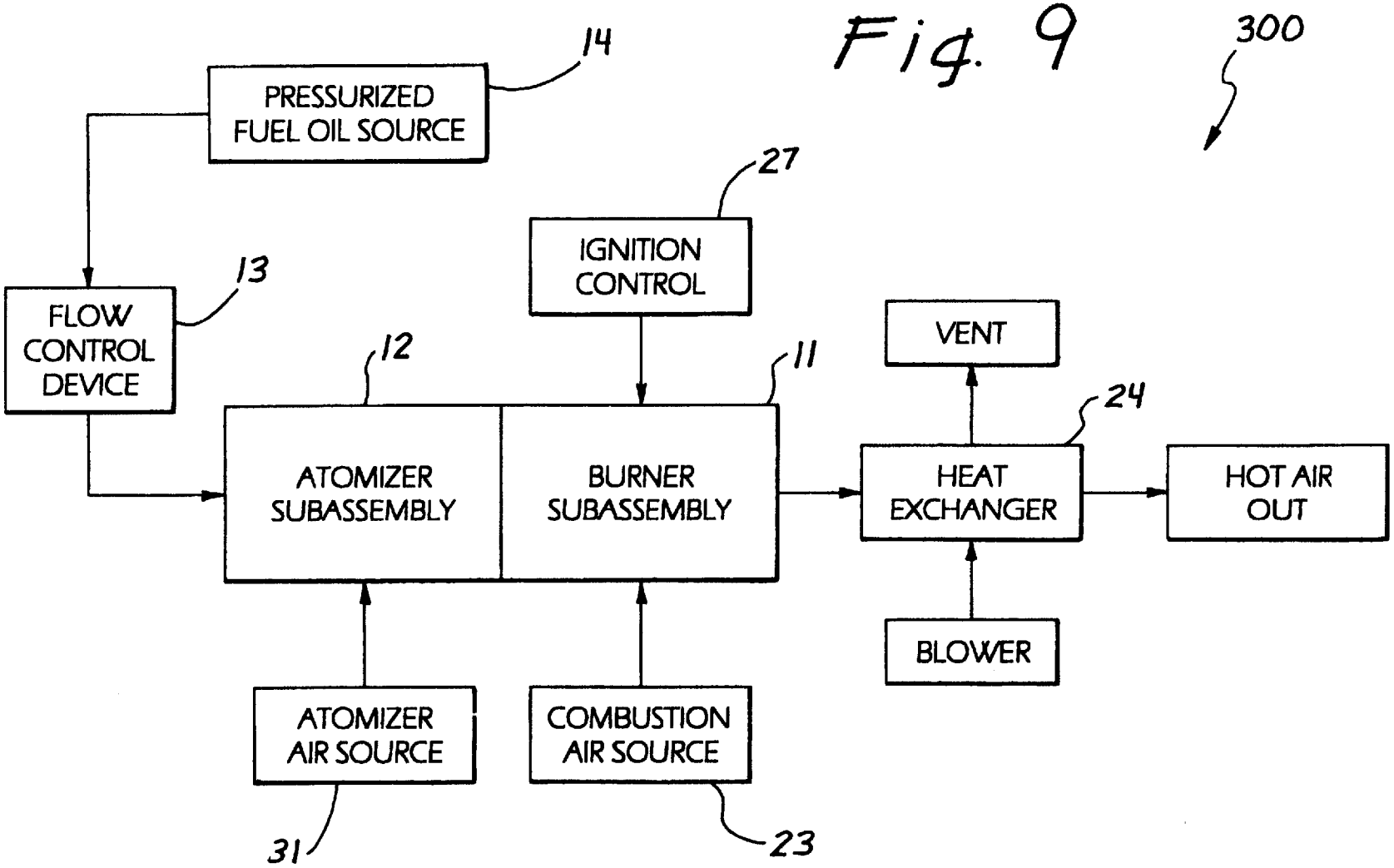
FIG. 9 is a block diagram of an appliance constructed according to the invention that utilizes the oil burner assembly connected to a fuel source, an atomizer air source, a combustion air source, and a heat exchanger.

More specifically, the illustrated burner subassembly 11 includes a cylindrically shaped burner tube 15 component (FIGS. 1, 2, and 4) that contains a cylindrically shaped combustion tube 16 (FIGS. 2 and 4). The combustion tube 16 combines with an ignition zone air adjustment sleeve 17, a rear combustion tube support 18, a combustion tube air adjustment sleeve 19, and a front combustion tube support 20 to define a combustion chamber 21 that is designated in FIG. 4. The lead line for the reference numeral 21 extends to an aperture in the rear combustion tube support 18 to designate the combustion chamber within these components. Apertures may be aligned as desired to alter air flow characteristics through the apertures.

A combustion air inlet tube 22 welded or otherwise suitably attached to the burner tube 15 (visible in FIGS. 1, 2, and 4) serves as an inlet to the combustion chamber 21 for air from a separate combustion air source 23. Hot exhaust gases flow from the combustion chamber 21 via the front combustion tube support 20 (as depicted by an arrow A in FIG. 4) to a separate heat exchanger 24 shown in FIG. 9. A sparkplug 25 or other suitable ignition device (FIG. 1) screws into a boss 26 (FIGS. 1, 2, and 4) that is welded or otherwise suitably attached to the burner tube 15. The sparkplug 25 is connected to an ignition control 27 (FIG. 9) that controls the sparkplug 25 to selectively ignite atomized fuel oil in the combustion chamber 21 under user control.

As a further idea of size, the illustrated burner subassembly 11 extends axially about 4.5 inches and has an outer diameter of about 2.0 inches. The combustion air inlet tube 22 extends axially about 2.0 inches and has an outer diameter of about 1.5 inches. Thus, the burner subassembly 11 is a compact unit. Of course, those dimensions may vary without departing from the inventive concepts claimed.

The atomizer subassembly 12 is attached with machine screws or other suitable means to an outer heat shield component 28 on the burner tube assembly 11 (FIGS. 1, 2, and 4.) One machine screw 29 is visible in FIG. 1. The atomizer subassembly 12 is an "airblast" atomizer in that it uses compressed air supplied to an atomizer air inlet 30 (FIGS. 1–4) to atomize the fuel oil (see U.S. Pat. Nos. 5,281,132 and 5,566,887 for related details.) For that purpose, a separate atomizer air source 31 (FIG. 9) is coupled to the inlet 30, and fuel oil is delivered through the flow control device 13 to an atomizer fuel body 32 (FIG. 3). Compressed air from the atomizer air source 31 passes over fuel oil emitted from the atomizer fuel body 32, as depicted by four arrows in FIG. 3, to produce atomized fuel oil, and the atomized fuel oil then passes through an outlet orifice 33 in an atomizer air cap 34. The atomizer air cap 34 is also identified in FIGS. 2 and 4).

The fuel oil is delivered to the atomizer fuel body 32 at rate of flow typically less than 0.5 gallons per hour by passing it through the flow control device 13. Fuel oil from the pressurized fuel oil source 14 is coupled by a suitable fuel oil line to a fitting 14A (i.e., a ninety-degree elbow). The fuel oil enters an inlet end 35 of a bore 36 in the body 37 of the flow control device 13 (FIGS. 3, 6, and 7), and from there passes through a passageway 38 that is identified in FIG. 7. The passageway 38 is bounded by a rod 39 that is disposed coaxially within the bore 36 and by the wall 40 of the bore 36. The fuel oil passes through the passageway 38 to an outlet end 41 of the bore 36, and from there to the atomizer fuel body 32.

The passageway 38 (FIG. 7) is a helically extending groove in the rod 39 that forms a thread 42 on the rod 39 (i.e., a radially projecting, helically extending rib). Precision machining or other suitable means is employed to produce the threaded rod 39 so that it fits closely within the bore 36. The rod 39 has a maximum diameter just slightly less than the diameter of the bore 36 so that the fuel oil must follow the passageway 38 in flowing from the inlet end 35 of the bore 36 to the outlet end 41.

As a further idea of size, the bore 36 has a 3⁄16 inch diameter. The plug is 1.25 inches long and it is threaded with a 10–32 thread. That arrangement results in the passageway 38 extending along a circuitous, helical path on the order of 28 inches long.

Figure 5:
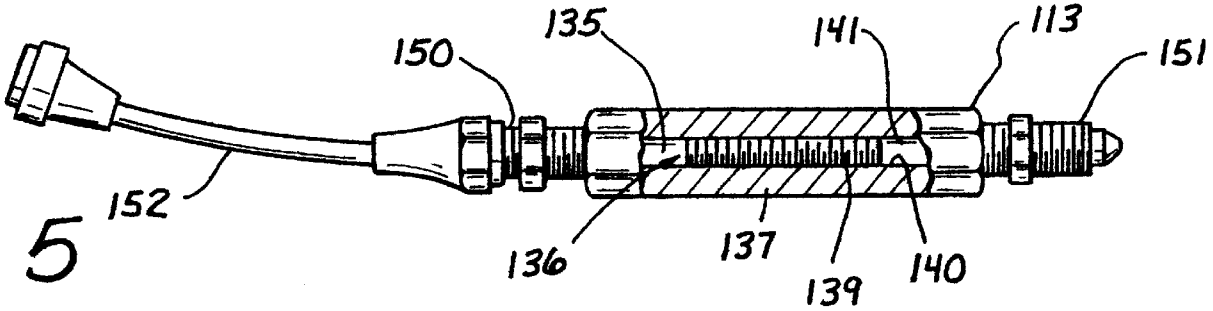
FIG. 5 is a side view of another flow control subassembly that is not integrally attached to the airblast atomizer subassembly.

Turning now to FIG. 5, it shows another flow control device 113 constructed according to the invention for placement in a fuel oil line apart from the atomizer subassembly 12. The flow control device 113 is similar to the flow control device 13 in many respects, and so only differences are described in further detail. For convenience, reference numerals designating parts of the flow control device 113 are increased by one hundred over those designating related parts of the flow control device 13.

Similar to the flow control device 13, the flow control device 113 includes a body 137 that defines a bore 136 with an inlet end 135 and an outlet end 141. A threaded rod 139 is disposed coaxially to form a passageway between the rod and a wall 140 of the bore 136. (similar to the passageway 38 in FIG. 7) Those components are configured to achieve a rate of flow of the fuel oil typically less than 0.5 gallons per hour.

Unlike the flow control device 13, however, the flow control device 113 includes an inlet fitting arrangement 150 and an outlet fitting arrangement 151 that enable connection of the flow control device 113 in a fuel oil line apart from the atomizer subassembly 12. Preferably, the inlet and outlet fitting arrangements 150 and 151 include conventional 3⁄8 inch copper/brass hardware that mates with conventional fuel-line hardware, such as that depicted by an extension 153 in FIG. 5.

From the foregoing description, one of ordinary skill can readily practice the invention, and even modify some of the components without departing from the claims. FIG. 8 shows one such modification in yet another flow control device 213 constructed according to the invention. The flow control device 213 is similar to the flow control devices 13 in many respects, and so only differences are described in further detail. For convenience, reference numerals designating parts of the flow control device 213 are increased by two hundred over those designating related parts of the flow control device 13.

The major difference is that the bore 236 is threaded to include a thread 242. The body 237 defines a threaded bore 236, and the rod 239 is smooth without a thread. This results in a passageway 238 of slightly greater length for the same 1.25-inch length of the rod 239, but size and shape can be adjusted to achieve the flow rate desired.

Thus, the invention takes advantage of fuel oil benefits in various applications, including some that were previously the domain of natural gas and liquid petroleum gas. It does so with a readily fabricated device embodying a new and non-obvious combination of elements that enable the use of fuel oil at a low firing rate.

The flow control device is simple and inexpensive to manufacture. It is compact. One embodiment takes the form of a precision machined threaded rod and a smooth bore, with the threads of the rod and the wall of the bore defining a passageway extending along a helical path that the fuel oil must follow. Another embodiment includes a threaded bore and a smooth rod. Passageway size and length can be accurately set for a desired flow rate, and the flow control device can be integrated into any of various airblast fuel oil burner designs to produce a low firing rate fuel oil burner assembly according to the invention. A low firing rate fuel oil burner appliance 300 (FIG. 9) results by combining the oil burner assembly 10 with any of various appropriate heat exchanger designs.

Recapitulating the methodology employed, a method for delivering fuel oil from a pressurized fuel oil source to an airblast atomizer subassembly on a low firing rate fuel oil burner assembly includes the step of providing a flow control device as described above. The method proceeds by delivering the fuel oil from the pressurized fuel oil source to the airblast atomizer subassembly through the passageway in the flow control device in order to achieve a rate of flow of the fuel oil typically equal to less than 0.5 gallons per hour.

Although exemplary embodiments have been shown and described, one of ordinary skill in the art may make many changes, modifications, and substitutions without necessarily departing from the spirit and scope of the invention. The flow control device can be configured to achieve a rate of flow of the fuel of 1.0 gallons per hour or more, for example, and the term "low firing rate" as used herein is define to include such a flow rate. Instead of just one flow control device, for another example, multiple flow control devices may be connected in tandem to achieve a flow rate of the fuel oil that is equal to the desired rate of flow of the fuel oil. The claims are intended to cover such a configuration. A standard thread need not be used, as another example, so long as at least one of the bore and the rod has a helically extending groove or channel in it that results in a radially projecting helical rib (a thread) that defines the specified passageway for the fuel oil to follow, and the term "being threaded" in the claims is hereby defined to include that alternative.

What is claimed is:

1. A method for delivering fuel oil from a pressurized fuel oil source to an airblast atomizer subassembly on a low firing rate fuel oil burner assembly, the method comprising:

providing a flow control device having a body defining a bore extending between an inlet end of the bore and an outlet end of the bore, said flow control device including a rod disposed coaxially within the bore in a close fitting relationship, and at least one of the bore and the rod being threaded to define a passageway extending along a circuitous path intermediate the inlet and outlet ends of the bore through which the fuel oil must pass in flowing from the input end of the bore to the output end of the bore, which passageway has a size and shape adapted to achieve a desired rate of flow of the fuel oil to the airblast atomizer subassembly; and delivering the fuel oil from the pressurized fuel oil source to the airblast atomizer subassembly through the passageway in the flow control device.

2. A flow control device for delivering fuel oil from a separate source of pressurized fuel to an airblast atomizer subassembly on a low firing rate fuel oil burner assembly, comprising:

a body defining a bore extending between an inlet end of the bore that is adapted to be connected in fluid communication with the separate source of pressurized fuel oil and an outlet end of the bore that is adapted to be connected in fluid communication with the atomizer subassembly; and a rod disposed coaxially within the bore in a close fitting relationship;

at least one of the bore and the rod being threaded to define a passageway extending along a circuitous path intermediate the inlet and outlet ends of the bore, which passageway has a size and shape adapted to achieve a desired rate of flow of the fuel oil to the airblast atomizer subassembly.

3. A flow control device as recited in claim 2, wherein the rod is threaded.

4. A flow control device as recited in claim 2, wherein the bore is threaded.

5. A flow control device as recited in claim 2, wherein the rod is about 1.25 inches long and at least one of the rod and the bore are threaded with a 10–32 thread.

6. A flow control device as recited in claim 2, wherein (i) the bore includes a cylindrically shaped wall having a minimum diameter, and (ii) the rod has a maximum diameter approximately the same as the minimum diameter of the wall of the bore so that the thread defines a passageway bounded by the rod and the wall of the bore that extends along a helically shaped path that the fuel oil must follow in flowing from the input end of the bore to the output end of the bore.

7. A flow control device as recited in claim 2, wherein the flow control device is adapted to be attached directly to the airblast atomizer subassembly.

8. A flow control device as recited in claim 2, wherein the flow control device includes an input fitting and an output fitting that enable placement of the flow control subassembly apart from the airblast atomizer subassembly.

9. An oil burner assembly, comprising:

a burner subassembly defining a combustion chamber in which to burn atomized fuel oil;

an airblast atomizer subassembly connected to the burner subassembly, the airblast atomizer subassembly being adapted to combine air with fuel oil received from a separate fuel oil source to produce the atomized fuel oil, and to communicate the atomized fuel oil to the combustion chamber; and a flow control device intermediate the fuel oil source and the airblast atomizer subassembly, said flow control device being adapted to communicate the fuel oil from the fuel oil source to the airblast atomizer subassembly at a desired rate of flow of the fuel oil;

the flow control device including a body defining a bore extending between an inlet end of the bore that is in fluid communication with the separate fuel oil source and an outlet end of the bore that is in fluid communication with the airblast atomizer subassembly;

the flow control device including a rod disposed coaxially within the bore in a close fitting relationship; and at least one of the bore and the rod being threaded to define a passageway extending along a circuitous path intermediate the inlet and outlet ends of the bore through which the fuel must flow in flowing from the input end of the bore to the output end of the bore, which passageway has a size and shape adapted to achieve the desired rate of flow of the fuel oil to the airblast atomizer subassembly.

10. An oil burner assembly as recited in claim 9, wherein the rod is threaded.

11. An oil burner assembly as recited in claim 9, wherein bore is threaded.

12. An oil burner assembly as recited in claim 9, wherein the rod is about 1.25 inches long and at least one of the rod and the bore are threaded with a 10–32 thread.

13. An oil burner assembly as recited in claim 9, wherein (i) the bore includes a cylindrically shaped wall having a minimum diameter, (ii) the rod is disposed coaxially within the bore, and (iii) the rod has a maximum diameter approximately the same as the minimum diameter of the wall of the bore so that the thread defines a passage bounded by the rod and the wall of the bore that extends along a helically shaped path that the fuel oil must follow in flowing from the input end of the bore to the output end of the bore.

14. An oil burner assembly as recited in claim 9, wherein the flow control device is attached directly to the airblast atomizer subassembly.

15. An oil burner assembly as recited in claim 9, wherein the flow control device includes an input fitting and an output fitting that enable placement of the flow control subassembly apart from the airblast atomizer subassembly.

16. An oil burner assembly as recited in claim 9, wherein the passageway has a size and shape adapted to achieve a rate of flow of the fuel oil equal to less than 0.5 gallons per hour.

* * * * *